United States Patent [19]

Bailey

[11] 3,997,342

[45] Dec. 14, 1976

[54] PHOTOCONDUCTIVE ELEMENT EXHIBITING PERSISTENT CONDUCTIVITY

[75] Inventor: David S. Bailey, Rochester, N.Y.

[73] Assignee: Eastman Kodak Company, Rochester, N.Y.

[22] Filed: Oct. 8, 1975

[21] Appl. No.: 620,726

[52] U.S. Cl. ..... 96/1.6; 96/1.5; 252/501

[51] Int. Cl.[2] ..... G03G 5/09

[58] Field of Search ..... 96/1.6, 1.5; 252/501

[56] References Cited

UNITED STATES PATENTS

| | | | |
|---|---|---|---|
| 3,287,113 | 11/1966 | Hoegl | 96/1.5 |
| 3,512,966 | 5/1970 | Shattuck et al. | 96/1.6 |
| 3,615,396 | 10/1971 | Gramza et al. | 252/501 |
| 3,615,414 | 10/1971 | Light | 96/1.6 |
| 3,684,502 | 8/1972 | Gramza et al. | 252/501 |
| 3,706,554 | 12/1972 | Fox et al. | 252/501 |

*Primary Examiner*—David Klein
*Assistant Examiner*—J. R. Hightower
*Attorney, Agent, or Firm*—J. R. Everett

[57] ABSTRACT

A photoconductive element having at least two layers, namely a charge-generation layer and a charge transport layer, is disclosed. The charge-generation layer contains a finely divided co-crystalline complex of (i) at least one polymer having an alkylidene diarylene group in a recurring unit and (ii) at least one pyrylium-type dye salt. The charge transport layer contains an organic photoconductive charge transport material exhibiting both kinetic and thermodynamic stability. Either one or both of the charge-generation and charge-transport layers of the element also contains a protonic acid material. The resultant photoconductive element exhibits persistent conductivity.

17 Claims, No Drawings

PHOTOCONDUCTIVE ELEMENT EXHIBITING PERSISTENT CONDUCTIVITY

FIELD OF THE INVENTION

This invention relates to electrophotography and particularly to an improved photoconductive element which exhibits persistent conductivity.

BACKGROUND OF THE INVENTION

Electrophotographic imaging processes and techniques have been extensively described in both the patent and other literature.

Various types of photoconductive insulating elements are known for use in electrophotographic imaging processes. In many conventional elements, the active components of the photoconductive insulating composition are contained in a single layer composition. This composition is typically affixed, for example, to a conductive support during the electrophotographic imaging process.

Among the many different kinds of photoconductive compositions which may be employed in typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Another especially useful photoconductive insulating composition which may be employed in a single active layer photoconductive element are the high-speed "heterogeneous" or aggregate photoconductive compositions described in Light, U.S. Pat. No. 3,615,414 issued Oct. 26, 1971 and Gramza et al, U.S. Pat. No. 3,732,180 issued May 8, 1973. These aggregate-containing photoconductive compositions have a continuous electrically insulating polymer phase containing a finely divided, particulate, co-crystalline complex of (i) at least one pyrylium-type dye salt and (ii) at least one polymer having an alkylidene diarylene group in a recurring unit.

Recently, an especially useful "multi-active," photoconductive insulating composition has been developed which contains a charge-generation layer in electrical contact with a charge-transport layer, the charge-generation layer comprising a multi-phase aggregate composition as described in U.S. Pat. No. 3,615,414 having a continuous, polymeric phase and dispersed in the continuous phase a co-crystalline complex of (i) a pyrylium-type dye salt, such as 2,4,6-substituted thiapyrylium dye salt, and (ii) a polymer having an alkylidene diarylene group as a repeating unit, and the charge-transport layer comprising an organic photoconductive charge-transport material. When a uniform-polarity electrostatic charge is applied to the surface of this multi-active element and the charge-generation layer thereof is subjected to an image wise exposure to activating radiation, the charge-generation layer generates charge carriers, i.e., electron-hole pairs, and injects them into the charge-transport layer which accepts and transports these charge carriers through the multi-active element to form an electrostatic charge pattern at or near the surface of the multi-active element corresponding to the imagewise exposure. The above-described, multi-active element is described in Berwick et al, copending U.S. Pat. application Ser. No. 534,979, filed Dec. 20, 1974, now abandoned.

In the past, in various publications, such as U.S. Pat. No. 3,037,861 issued Nov. 22, 1966 and in U.S. Pat. Nos. 3,287,113 through 3,287,123 issued Apr. 19, 1966, it has been disclosed that various protonic acids (sometimes also referred to as electron acceptors, Lewis acids, or Bronsted acids) may be incorporated as chemical sensitizers or "activators" in organic photoconductive compositions, particularly homogeneous compositions composed of an organic photoconductor(s) solubilized in a polymeric binder.

In addition, in other literature publications it has been disclosed that when various protonic acids are added to conventional photoconductive compositions, such as various dyesensitized homogeneous organic photoconductive compositions containing certain polymeric organic photoconductors such as poly(vinyl carbazoles), poly(acryl phenothiazines), etc. or certain monomeric organic photoconductors such as monomeric dialkyl aromatic amines, one can impart a persistent conductivity effect (sometimes referred to as a memory effect) to the photoconductive composition. In this regard, one may refer to such publications as Y. Hayashi, M. Kuroda, and A. Inami in Bull. Chem. Soc. Japan, 39, 1660, (1966); U.S. Pat. No. 3,512,966; and Williams, Pfister, and Abkowitz in Tappi, 56, 129 (1973).

The persistent conductivity effect referred to above has reference to the property of a photoconductive composition which possesses such a capability to generate an electrical image, i.e., an electrostatic charge image, in response to a single imaging cycle, e.g., upon being subjected to a single imagewise exposure in the presence of an electrical field, which electrical image persists over a time period sufficient to produce (from that one electrical image) a plurality of image copies. In terms of conventional electrophotographic transfer processes, this means that a single electrical image produced by an imagewise exposed photoconductive composition must have a lifetime sufficient to provide a developable background to charge image differential over a plurality of subsequent process cycles without re-exposing the photoconductive composition to the original radiation image pattern. For example, a photoconductive composition which exhibits persistent conductivity can be given an initial uniform electrostatic charge and exposed to an initial imagewise radiation pattern to form a latent electrical image. This latent electrical image can then be developed by application of a suitable electrographic developer into a visible electrographic toner image. The resultant toner image can then be transferred to a receiver sheet to form a first copy corresponding to the original imagewise exposure. The photoconductive composition bearing the original latent electrical image (by virtue of the persistent character of this electrical image) can then be re-charged by application of an electrical field, e.g., by application of a uniform electrostatic charge, and, in the absence of any imagewise re-exposure, one obtains a developable, latent electrical image corresponding to the original imagewise exposure so that a second copy of the original imagewise exposure can be generated.

In a photoconductive composition exhibiting ideal persistent conductivity properties, one would hope to be able to generate a number of copies, e.g., 5 to 50 or more, using only a single imagewise exposure. In addition, one would hope to be able to obtain a persistent electrical image having a 5 to 50 copy lifetime without having to use extremely high energy radiation exposure levels to form the original persistent electrical image pattern. That is, one would like to be able to use light radiation sources having an energy output similar to that of radiation sources used in conventional electrophotographic reproduction devices. Of course, another desirable property of a photoconductive composition intended for use as persistent conductivity medium is that the composition be capable of reuse. For example, once one has obtained the desired number of copies from the persistent electrical image pattern formed by this composition, one would like to be able to erase this electrical image and then reuse the photoconductive composition to form additional persistent electrical images.

To date, the art has claimed some success in obtaining persistent conductivity image patterns with certain types of single active layer "homogeneous" organic photoconductive compositions (i.e., photoconductive compositions composed of a solid solution of organic photoconductor and binder) by incorporating therein a dyestuff and an activator selected from the group consisting of organic carboxylic acids, nitrophenols, nitroanilines, and carboxylic acid anhydrides. (See U.S. Pat. No. 3,512,966 noted above.) Unfortunately, however, it has been found that when incorporation of the same or similar types of activators is attempted with single layer photoconductive elements containing the aforementioned high-speed, "heterogeneous" or "aggregate" photoconductive compositions described in Light, U.S. Pat. No. 3,615,414, issued Oct. 26, 1971 and Gramza et. al. U.S. Pat. No. 3,732,180 issued May 8, 1973, the resultant, single active layer, aggregate photoconductive composition exhibits little or no persistent conductivity capability.

SUMMARY OF THE INVENTION

In accord with the present invention it has been found, quite surprisingly, that a multi-active photoconductive element of the type described in the above-identified Berwick et. al. application which contains an aggregate photoconductive composition as the charge-generation layer thereof can be adapted to provide persistent conductivity by the incorporation of certain protonic acid materials. This is considered particularly remarkable because, to date, it has been found that when similar or identical protonic acid materials are incorporated in conventional, single active layer, aggregate photoconductive compositions of the type described in the above-identified Light and Gramza et. al. patents, one is unable to obtain a useful level of persistent conductivity.

As described earlier herein and in the above-referenced Berwick et. al. patent application, the multi-active photoconductive elements used in the present invention have an aggregate charge-generation layer in electrical contact with a charge-transport layer containing an organic photoconductive charge-transport material. The persistent conductivity capability which distinguishes the multi-active elements of the invention from the previous multi-active elements described by Berwick et. al. is obtained by incorporating an effective amount of certain protonic acid materials in the multi-active element and, in addition, by confining the choice of organic photoconductive charge-transport materials described for use by Berwick et. al. to those charge-transport materials which exhibit both thermodynamic and kinetic stability. Charge-transport materials which exhibit thermodynamic stability possess a fairly low polarographic oxidation potential between about +0.90 and +0.50 volts (measured as described hereinafter). Charge-transport materials which possess suitable kinetic stability exhibit the capability of forming chemically stable, radical cations, that is, radical cations that will not readily decompose, dimerize, disproportionate, or the like during usage, for example, at room temperature and pressure conditions, i.e. 22° C, 1 atmosphere.

In accord with the invention, a variety of different embodiments can be formulated. Based on these various embodiments, as illustrated in the appended representative Examples of the invention, it has been found that the persistent conductivity multi-active photoconductive elements of the invention can provide the following advantages:

1. The use of imagewise radiation exposure intensities comparable to or less than those used with conventional electrophotographic elements currently employed, for example, in various office copy-duplicating machines.
2. The production of persistent electrical images which exhibit large voltage differentials for good image-background differential toning.
3. The capability of providing a large number of copies from a single original exposure without the preparation of a permanent master.
4. The capability of storing a persistent electrical image for many hours for recall and use at a future time.
5. The capability of storing many persistent electrical images on successive elements for producing sequentially coherent documents.
6. The capability of adding new information onto these stored electrical images.
7. The persisting electrical image patterns can be thermally erased at reasonable temperatures and times to return the multi-active photoconductive elements of the invention to its original non-imaged form for subsequent reuse.

DESCRIPTION OF THE PREFERRED EMBODIMENTS

As set forth hereinbefore, an essential feature of the persistent conductivity multi-active photoconductive elements of the invention resides in the use of certain protonic acids in the multi-active element. It has been found that the location of a suitable protonic acid in the multi-active element, i.e., in the aggregate charge-generation layer or the charge transport layer of the multi-active element, is not critical. Useful results have been obtained incorporating a suitable protonic acid in either or both of the charge-generation layer and the charge-transport layers of the resultant element.

The particular protonic acid selected for use in accord with the invention can be selected from a variety of such materials known in the art and which are selected in accord with the criteria provided herein.

As used in the present application, the term protonic acid is used in accord with its conventional meaning to refer to materials having a labile hydrogen atom, i.e., materials which yield a hydrogen ion.

Protonic acid materials useful in the present invention include (1) substituted carbocyclic aromatic acids selected from the group consisting of (a) substituted carbocyclic aromtic carboxylic acids, (b) substituted phenols, and (c) substituted naphthols; (2) substituted aliphatic- and substituted alicyclic carboxylic acids; and (3) substituted heterocyclic aromatic carboxylic acids, each of the aforementioned protonic acid materials characterized by the presence of one or more electron-withdrawing substituents such that the sum of the sigma values (Hammett sigma values in the case of aromatic acids and Taft sigma values in the case of the aliphatic and alicyclic carboxylic acids) for the substituents is equal to or greater than 1.0.

In the case of the protonic acid materials selected from the groups designated (1*a*) and (3) above, these acids represent materials having a carbocylic aromatic ring or a heterocyclic aromatic ring, respectively, as a central nucleus with a carboxylic acid group (i.e., —COOH) chemically bonded to one of the nucleus ring atoms. The aromatic ring nucleus of the group (1*a*) and (3) materials noted above may contain one or more aromatic rings, with typical aromatic ring nuclei containing 4 to about 14 carbon atoms and, if hetero atoms are present, 1 to about 3 hetero atoms such as oxygen or nitrogen hetero atoms.

In the case of the group (2) protonic acid materials noted above, i.e., the substituted aliphatic and alicyclic carboxylic acids, these materials are characterized by the presence of an aliphatic or alicyclic group, typically having from one to about eight carbon atoms, chemically bonded to a carboxylic acid group.

Any of a wide variety of various substituents, including both electron donating and electron withdrawing substituents, may be present on the protonic acid materials of groups (1) to (3) above, provided that the substituents which are present include one or more electron withdrawing groups such that the sum of the sigma values (Hammett or Taft sigma values as the case may be) for all the substituents is equal to or greater than 1.0.

A partial listing of representative electron withdrawing groups which may be present as substituents on the protonic acids used in the present invention includes nitro groups; hydroxy groups; cyano groups; cyanoalkylene groups and dicyanoalkylene groups, preferably having 1 to about 6 carbon atoms in the alkylene group; carboxylic acid anhydride and carboxylic acid groups; quinone groups; halogen groups, preferably fluorine; halogenated alkyl groups, preferably containing 1 to about 6 carbon atoms in the alkyl groups; halogenated phenyls; and the like.

A partial listing of representative protonic acid materials useful in the present invention may be found in the appended Examples. As illustrated in the appended Examples, one class of protonic acid materials which have been found especially effective for use in the present invention are substituted carbocyclic aromatic carboxylic acids having a single carbocylic aromatic ring bearing one or more carboxylic acid substituents and one or more nitro or halogen substituents, e.g., pentafluorobenzoic acid and halogenated salicyclic acids such as 5-fluorosalicyclic acid (i.e., 5-fluoro-2-hydroxybenzoic acid).

Another especially effective class of protonic acid materials useful in the present invention are the substituted aliphatic carboxylic acid materials containing nitro-substituted or halogenated phenyl groups attached as substituents to the aliphatic carboxylic acid, e.g., halogenated mandelic acids having the formula

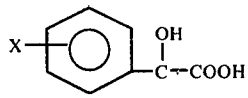

where X represents a nitro or halogen group.

Hammett sigma and Taft sigma values for the substituents of the protonic acids can be determined by reference to the published literature or can be determined directly using known determination procedures. Exemplary meta and para sigma values and procedures for their determination are set forth by H. VanBekkum, P. E. Verkade and B. M. Wepster in Rec. Trav. Chim. volume 78, page 815, published 1959; by P. R. Wells in Chem. Revs. volume 63, page 171, published 1963, by H. H. Jaffe, Chem. Revs., volume 53, page 191, published 1953; by M. J. S. Dewar and P. J. Grisdale in J. Amer. Chem. Soc., volume 84, page 3548, published 1962; and by Barlin and Perrin in Quart. Revs., volume 20, page 75 et. seq., published 1966.

In accordance with established practice, electron withdrawing (electronegative) substituents are assigned positive sigma values while electron donating (electropositive) substituents are assigned negative sigma values.

Sigma values for a given substituent are noted to vary as a function of position and resonance induced by conjugation. For example, a given substituent to a phenyl ring can exhibit one sigma value in the meta position and another when in the para position. A few substituents, such as nitro, dimethylamino and cyano substituents, for example, produce a conjugated system as para position substituents to 2 and 3 position phenyl rings and accordingly, are assigned differing sigma values depending on the ring to which they are appended. A partial listing of representative is Hammett sigma values for ring substituents of aromatic acids is set forth in Tables 1 and 2.

TABLE 1

Hammett sigma values for aromatic acids

| Substituent | meta | para |
|---|---|---|
| H | 0 | 0 |
| Me | −0.07 | −0.17 |
| Et | −0.07 | −0.15 |
| $Bu^t$ | −0.10 | −0.20 |
| $CH_2OH$ | 0.08* | 0.08* |
| $CH_2Cl$ | | 0.18 |
| $CH_2 . CN$ | | 0.01 |
| $CH_2 . CH_2 . CO_2H$ | −0.03 | −0.07 |
| CH=CHPh | 0.14 | |
| 3,4-$[CH_2]_3$(fused ring) | | −0.26 |
| CHO | 0.36 | 0.22 |
| | | (1.03)* |
| $CF_3$ | 0.47 | 0.54 |
| $CO_2H$ | 0.37 | 0.41 |
| $CO_2Me$ | 0.32 | 0.39 |
| $CO_2Et$ | 0.37 | 0.45 |
| $CO . NH_2$ | 0.28 | 0.36 |
| Ac (acyl) | 0.38 | 0.50 |
| | | (0.84)* |
| Benzyl | 0.34 | 0.46 |
| —CN | 0.61 | 0.66 |
| | | (0.88)* |
| $NH_2$ | −0.04 | −0.66 |
| | | (0.15)* |
| OH | 0.10 | −0.37 |
| OMe | 0.08 | −0.27 |
| | | (−0.11)* |
| $OC_5H_{11}$ | 0.1 | −0.34 |
| OPh | 0.25 | −0.32 |
| $O . CF_3$ | 0.36 | 0.32 |
| OAc | 0.39 | 0.31 |
| SMe | 0.15 | 0.00 |
| SOMe | 0.52 | 0.49 |

TABLE 1-continued

| Hammett sigma values for aromatic acids | | |
|---|---|---|
| Substituent | meta | para |
| $SO_2Me$ | 0.68 | 0.72 (0.92)* |
| —SCN | | 0.52 |
| F | 0.34 | 0.06 |
| Cl | 0.37 | 0.23 |
| $NMe_2$ | −0.05 | −0.83 (−0.12)* |
| N=NPh | | 0.64 |
| $NO_2$ | 0.71 | 0.78 (1.24)* |
| Br | 0.39 | 0.27 |
| I | 0.35 | 0.30 |
| SeMe | 0.1 | 0.0 |

*For Phenols

TABLE 2

| Hammett sigma values for ortho substituents in benzoic acids | |
|---|---|
| Substituent | ortho sigma value |
| Me | 0.29 |
| Et | 0.41 |
| Pr' | 0.56 |
| 2,3-[CH]$_4$($\alpha$-naphthyl) | 0.50 |
| —CN | ~1.06 |
| $CO_2H$ | 0.95 |
| $CONH_2$ | ~0.45 |
| $NO_2$ | 1.99 |
| OH | 1.22 |
| OMe | 0.12 |
| OPr' | −0.04 |
| OPh | 0.67 |
| OAc | −0.37 |
| F | 0.93 |
| Cl | 1.28 |
| Br | 1.35 |
| I | 1.34 |
| Ph | 0.74 |

A partial listing of illustrative Taft sigma values for aliphatic acids is set forth in Table 3.

TABLE 3

| Taft sigma values ($\sigma$) for aliphatic systems | |
|---|---|
| Substituent | $\sigma$ |
| H | 0.49 |
| Me | 0.00 |
| Et | −0.10 |
| Ph | 0.60 |
| $CF_3$ | 2.61 |
| $CCl_3$ | 2.65 |
| $CH_2CN$ | 1.30 |
| 2-Thienyl | 1.31 |
| 2-Furoyl | 0.25 |
| 3-Indolyl | −0.06 |
| Benzyl | 2.2 |
| $CO_2H$ | 2.08 |
| $CO_2Me$ | 2.00 |
| $NO_2$ | 4.0 |
| OH | 1.34 |
| OMe | 1.81 |
| OBu" | 1.68 |
| OPh | 2.43 |
| SMe | 1.56 |
| $SO_2$ . ME | 3.68 |

In view of the diversity of materials useful as protonic acids in the present invention, the relative amount of a specific material which is used in a representative multi-active element of the invention may vary quite widely. Various factors influencing the relative amount of the protonic acid material used in a given multi-active element include the following: The location of the protonic acid in either or both of the charge-generation layer and/or the charge transport layer of the multi-active element (best results have generally been obtained by incorporating the protonic acid in the charge-transport layer of a typical multi-active element); the particular organic photoconductive charge-transport material present in the multi-active element, the relative strength of a particular protonic acid material under consideration, and the like. In general, useful results have been obtained wherein the amount of protonic acid contained within a particular multi-active element is within the range of from about 0.5 to about 7.5 percent based on the total dry weight of the material contained in both the charge-generation and the charge-transport layers of the multi-active element. As noted above, best results have generally been obtained in accord with the invention when the protonic acid selected is present in at least the charge-transport layer of the multi-active element and preferably within a range of from about 1 to about 5 weight percent based on the dry weight of material contained in the charge-transport layer.

As explained previously herein, the multi-active photoconductive elements in which the protonic acids as described above are incorporated represent a type of multi-active photoconductive element within the class of multi-active elements described in Berwick et al, copending U.S. Pat. application Ser. No. 534,979, referred to above and incorporated herein by reference thereto. Such multi-active photoconductive elements are unitary, multi-layer elements having at least two layers, namely a charge-generation layer in electrical contact with a charge-transport layer. The charge-generation layer is composed of a multi-phase aggregate composition of the type described in Light, U.S. Pat. No. 3,615,414. The charge-generation layer, therefore, contains a continuous electrically insulating, polymer phase and, dispersed in the continuous phase, a discontinuous phase comprising a finely-divided, particular, co-crystalline complex of (i) at least one polymer having an alkylidene diarylene group in a recurring unit and (ii) at least one pyrylium-type dye salt such as a pyrylium, thiapyrylium, or a selenapyrylium dye salt, the thiapyrylium dye salts being especially useful. In addition, if desired and in accord with especially advantageous embodiments of the present invention, one or more organic photoconducting charge transport materials may also be incorporated in the charge-generation layer, preferably in solid solution with the continuous phase thereof. Additional information concerning the use of such organic photoconducting charge-transport materials in the charge-generation layer is contained hereinafter.

The charge-transport layer of the aforementioned multi-active, photoconductive insulating element is free of the particulate, co-crystalline-complex material and the pyrylium-type dye salts described above. Typically, the charge-transport layer contains a film-forming polymer in addition to one or more charge-transport materials. Preferably, although not necessarily, the charge-transport material(s) has a principal radiation absorption band below about 475 nm and is transparent to activating radiation for the charge-generation layer.

The charge-transport layer used in the multi-active element of the present invention typically comprises an organic material-containing composition. The term "organic", as used herein, refers to both organic and metallo-organic materials.

The charge-transport layer used in the present invention contains as the active charge-transport material one or more p-type organic photoconductors capable of accepting and transporting charge carriers generated by the charge-generation layer. The charge-transport layer is free of the above-mentioned co-crystalline complex and any pyrylium-type dye salt. Useful charge-transport materials can generally be divided into two classes depending upon the electronic charge-transport properties of the material. That is, most charge-transport materials generally will preferentially accept and transport either positive charges, i.e. holes, or negative charges, i.e. electrons, generated by the charge-generation layer. Of course, there are many materials which will accept and transport either positive charges or negative charges; however, even these "amphoteric" materials generally, upon closer investigation, will be found to possess at least a slight preference for the conduction of either positive charge carriers or negative charge carriers.

Those materials which exhibit a preference for the conduction of positive charge carriers are referred to herein as "p-type" charge-transport materials, and these are the materials which are employed as the charge transport materials in the multi-active elements of the present invention.

The capability of a given organic photoconductor to accept and transport charge carriers generated by the charge-generation layer used in the multi-active elements of the invention can be conveniently determined by coating a layer of the particular organic photoconductor under consideration for use as a charge-transport material (e.g. a 5 to 10 micron thick layer containing about 30 weight percent or more of the organic photoconductive material together with up to about 70 weight percent of a binder, if one is used), on the surface of a charge-generation layer (e.g., a 0.5 to 2 micron aggregate charge-generation layer such as that described more specifically in Example 1 hereinafter) which is, in turn, coated on a conducting substrate. The resultant unitary element may then be subjected to a conventional electrophotographic processing sequence including (a) applying a uniform electrostatic charge to the surface of the layer to be tested for charge-transport properties in the absence of activating radiation while the conducting substrate is maintained at a suitable reference potential thereby creating a potential difference, $V_o$, across the element of, for example, about ±200-600 volts, (b) exposing the charge-generation layer of the resultant element to activating radiation, for example, 680 nm. light energy of 20 ergs/cm.$^2$, and (c) determining the change in the magnitude of the charge initially applied to the element caused by the exposure to activating radiation, i.e., calculating the change in potential difference, $\Delta.^V$, across the element as a result of the exposure. If the particular organic photoconductor under consideration as a charge-transport material possesses no charge-transport capability, then the ratio of the quantity $V_o$ to the quantity $V_o - \Delta V$, i.e., the ratio $V_o : (V_o - \Delta V)$, will, to a good approximation, equal the ratio of the sum of the physical thicknesses of the charge-transport layer, $T_{ct}$, and the charge-generation layer, $T_{cg}$, to the physical thickness of the charge-generation layer by itself (i.e. $T_{cg}$), i.e., the ratio $(T_{ct} + T_{cg}) : T_{cg}$. That is, $V_o:(V_o-\Delta V) \simeq (T_{ct}+T_{cg}) : T_{cg}$. If, on the other hand, the particular organic photoconductor under consideration possesses charge-transport capability then the ratio $V_o:(V_o - \Delta V)$ will be greater than the ratio $(T_{ct} + T_{cg}) : T_{cg}$, i.e., $V_o:(V_o - \Delta V) > (T_{ct} + T_{cg}) : T_{cg}$. If, as is often the case, a binder is employed in the charge-transport layer when the above-described charge-transfer determination is made, care should be taken to account for any charge-transport capability exhibited by the charge-transport layer which may be imparted solely by the binder, rather than by the particular organic photoconductor being evaluated. For example, certain polymeric materials, particularly certain aromatic- or heterocyclic-group-containing polymers have been found to be capable of accepting and transporting at least some of the charge carriers which are injected to it by an adjacent charge-generation layer. For this reason, it is advantageous when evaluating various organic photoconductor materials for charge-transport properties to employ a binder, if one is needed or desired, which exhibits little or no charge-transport capability with respect to charge carriers generated by the charge-generation layer of the present invention, for example, a poly(styrene) polymer.

Among the organic photoconductors which have been found especially preferred as charge-transport materials in the present invention are materials wholly or partially transparent to, and therefore insensitive or substantially insensitive to, the activating radiation used in the present invention. Accordingly, if desired, exposure of the charge-generation layer can be effected by activating radiation which passes through the charge-transport layer before impinging on the generation layer. The organic photoconductors preferred for use as charge-transport materials in the charge-transport layer do not, in fact, function as photoconductors in the present invention because such materials are insensitive to activating radiation and, therefore, do not generate electron-hole pairs upon exposure to activating radiation; rather, these materials serve to transport the charge carriers generated by the charge-generation layer. In most cases, the charge-transport materials which are prepared for use in a multi-active element of the invention which is sensitive to visible light radiation are organic photoconductors whose principal absorption band lies in a region of the spectrum below about 475 nm. and preferably below about 400 nm. The phrase "organic photoconductors whose principal absorption band is below about 400 nm." refers herein to photoconductors which are both colorless and transparent to visible light, i.e., do not absorb visible light. Those materials which exhibit little or no absorption above 475 nm. but do exhibit some absorption of radiation in the 400 to 475 nm. region will exhibit a yellow coloration but will remain transparent to visible light in the 475 to 700 nm. region of the visible spectrum.

Of course, where the charge-generation layer of the multi-active element of the invention is exposed to activating radiation without having to expose through the charge-transport layer, it is possible to use organic photoconductive materials in the charge-transport layer which are highly colored or opaque.

Another useful criteria which has been found helpful in characterizing those charge-transport materials which seem to operate most effectively in the multi-active element of the invention is the finding that, to date, the more useful charge-transport materials are organic photoconductive materials which exhibit a hole or electron drift mobility greater than about $10^{-9}$ cm.$^2$/volt-sec., preferably greater than about $10^{-6}$cm$^2$/volt-sec.

Although a variety of different p-type organic photoconductors may be used in the charge-transport layer of the present invention, it has been found, as noted above, that p-type charge-transport materials useful in the invention should be both thermodynamically and kinetically stable. The thermodynamic stability of p-type transport materials useful in the invention may be measured by use of polarographic oxidation potentials. It has been found that p-type charge-transport materials exhibiting sufficient thermodynamic stability for use in the invention should have fairly low polarographic oxidation potentials between about +0.90 and +0.50 volts as measured against a stand calomel reference electrode at $10^{-3}$ Molar concentration in acetonitrile at room temperature and pressure conditions, i.e., 22° C. and one atmosphere.

The charge-transport material should also exhibit kinetic stability, i.e., the capability of forming radical cations that are chemically stable specie under normal operating conditions. Chemically stable radical cations do not readily decompose, dimerize, disproportionate, or the like during usage, for example, at room temperature and pressure conditions (e.g., at 22° C., 1 atm, where these are to be the "normal" operating conditions).

The kinetic stability of p-type charge-transport materials useful in the invention has reference to the capability of useful p-type charge-transport materials to form radical cations that do not undergo relatively facile intramolecular or intermolecular decomposition reactions. For example, it has been found that triarylamine-containing p-type charge-transport materials that form cations which exhibit decomposition rates less than 10 $mole^{-1}$ $sec^{-1}$ [as determined by the method described in S. C. Creason et al., J. Org. Chem., 37, 4440 (1972)] are useful in the present invention because of their low decomposition rates. It has also been found that certain alkylamine-containing p-type charge-transport materials, such as dialkylamines, form radical cations which readily disproportionate through formation of aldehydes and dealkylated amines. See S. G. Cohen et al., Chem. Revs., 73, 141 (1973). Therefore, such alkylamine materials, because of the chemical instability of their radical cations, are not kinetically stable materials useful in the invention.

The importance of using a p-type charge-transport material which exhibits thermodynamic and kinetic stability is illustrated hereinafter in the appended working examples.

More specifically in Examples 2 and 3 one of the charge-transfer materials selected for use is 4,4'-bis-(N,N-diethylamino)tetraphenylmethane. This organic photoconductive material is known to form radical cations that undergo a decomposition resulting in loss of an N-alkyl group. Accordingly, the charge-transport material used in Examples 2 and 3 is not kinetically stable because it does not possess the capability of forming radical cations that are chemically stable species under the operating conditions used in these examples, namely room temperature and 1 atmosphere pressure conditions. As a result, and as shown in Examples 2 and 3, these multi-active photoconductive elements do not exhibit useful levels of persistent conductivity. Similarly, it is shown in appended Examples 22 and 23 that charge-transport materials which are not thermodynamically stable, i.e., they exhibit oxidation potentials greater than +0.50 to +0.90 volt range specified hereinabove, also have an undesirable effect on the persistent conductivity properties of the multi-active element. In Examples 21 and 22 the charge-transport materials selected, i.e., tri-p-bromophenolamine and tri-phenylamine, respectively, are known to possess an oxidation potential above +0.90 as measured using the technique described herein. And, as illustrated in Examples 22 and 23, little or no useful persistent conductivity is exhibited by these multi-active elements.

If desired, a relatively simple, practical test may be performed to check the thermodynamic and kinetic stability properties of a given p-type charge-transport material. This test may be conducted merely by preparing a sample photoconductive insulating film of the type labelled "Multi-Active Photoconductive Film" and described more specifically in Example 1 appended hereto. In place of the tri-p-tolylamine charge-transport material used in the charge transport layer of the multi-active film element of Example 1, one inserts an equivalent amount of the particular charge-transport material to be tested. The sample film is then subjected to Test No. 1 set forth in the appended Examples. If, after ten charge cycles of Test No. 1, one measures a $\Delta V$, as defined in Test No. 1, of greater than 300 volts, then it is considered that the particular charge-transport material being tested has adequate thermodynamic and kinetic stability.

Having regard to the foregoing criteria relating to useful p-type charge-transport materials to be employed in the multi-active elements of the present invention, it is understood that any of a wide variety of such materials which meet these criteria may be used. A partial listing of representative classes of p-type charge-transport materials from which p-type charge-transport materials useful in the present invention may be selected is included hereinafter. (In the following list of representative classes of p-type charge-transport materials, it will be understood that not all members of these classes will be useful in the present invention, rather those members which are useful will be members which meet the thermodynamic and kinetic stability criteria specified hereinabove.)

1. certain arylamine-containing materials including certain monoarylamines, diarylamines, triarylamines, as well as polymeric arylamines. A partial listing of useful arylamine organic photoconductors include certain of the particular nonpolymeric triphenylamines illustrated in Klupfel et al., U.S. Pat. No. 3,180,730 issued Apr. 27, 1965; certain of the polymeric triarylamines described in Fox U.S. Pat. No. 3,240,597 issued Mar. 15, 1966; tritolylamine; certain of the $\alpha,\alpha'$-bis-(aminobenzylidene)arylidacetonitriles described in Merrill, U.S. Pat. No. 3,653,887 issued Apr. 4, 1972; and certain of the materials described in Contois et al., U.S. Pat. No. 3,873,312 issued Mar. 25, 1975 which have a central divalent aromatic ring joined to two amino-substituted styryl groups through the vinylene linkage of the styryl groups;

2. certain polyarylalkane materials of the type described in Noe et al., U.S. Pat. No. 3,274,000 issued Sept. 20, 1966. Preferred polyarylalkane photoconductors can be represented by the formula:

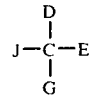

wherein J and E represent a hydrogen atom, an aryl group, or an alkyl group and D and G represent substituted aryl groups having as a substituent thereof a group represented by the formula:

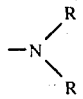

wherein R represents an alkyl substituted aryl such as a tolyl group. Additional information concerning certain of these latter polyarylalkane materials may be found in Rule et. al., copending U.S. Pat. application Ser. No. 534,953, filed Dec. 20, 1974.

3. other useful p-type charge-transport materials which may be employed in the present invention are any of the p-type organic photoconductors, including metallo-organo materials, which meet the aforementioned criteria and which are useful in electrophotographic processes, e.g. carbazol-containing materials such as vinyl carbazoles, poly(vinyl carbazoles) and halogenated poly(vinyl carbazoles).

As noted earlier herein, in accord with an especially preferred embodiment of the present invention, the organic photoconductive materials useful herein as charge-transport materials are advantageously those materials which exhibit little or no photosensitivity to radiation within the wavelength range to which the charge-generation layer is sensitive, i.e., radiation which causes the charge-generation layer to produce electron-hole pairs. Thus, in accord with a preferred embodiment of the invention wherein the multi-active element of the invention is to be exposed to visible electromagnetic radiation, i.e., radiation within the range of from about 400 to about 700 nm., and wherein the charge-generation layer contains a co-crystalline complex of the type described in greater detail hereinafter which is sensitive to radiation within the range of from about 520 nm. to about 700 nm.; it is advantageous to select as the organic photoconductive material to be used in the charge-transport layer, an organic material which is photosensitive to light outside the 520 – 700 nm. region of the spectrum, preferably in the spectral region below about 475 nm. and advantageously below about 400 nm.

The charge-transport layer may consist entirely of the charge-transport materials described hereinabove, or, as is more usually the case, the charge-transport layer may contain a mixture of the charge-transport material in a suitable film-forming polymeric binder material. The binder material may, if it is an electrically insulating material, help to provide the charge-transport layer with electrical insulating characteristics, and it also serves as a film-forming material useful in (a) coating the charge-transport layer, (b) adhering the charge-transport layer to an adjacent substrate, and (c) providing a smooth, easy to clean, and wear resistant surface. Of course, in instances where the charge-transport material may be conveniently applied without a separate binder, for example, where the charge-transport material is itself a polymeric material, such as a polymeric arylamine, there may be no need to use a separate polymeric binder. However, even in many of these cases, the use of a polymeric binder may enhance desirable physical properties such as adhesion, resistance to cracking, etc.

Where a polymeric binder material is employed in the charge-transport layer, the optimum ratio of charge-transport material to binder material may vary widely depending on the particular polymeric binder(s) and particular charge-transport material(s) employed. In general, it has been found that, when a binder material is employed, useful results are obtained wherein the amount of active charge-transport material contained within the charge-transport layer varies within the range of from about 5 to about 90 weight percent based on the dry weight of the charge-transport layer.

A partial listing of representative materials which may be employed as binders in the charge-transport layer are film-forming polymeric materials having a fairly high dielectric strength and good electrically insulating properties. Such binders include styrene-butadiene copolymers; polyvinyl toluenestyrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene; isobutylene polymers; polyesters, such as poly[ethylene-co-alkylenebis(alkyleneoxyaryl) phenylenedicarboxylate]; phenolformaldehyde resins; ketone resins; polycarbonates, polythiocarbonates; poly[ethylene-co-isopropylidene-2,2-bis(ethyleneoxyphenylene)terephthalate]; copolymers of vinyl haloarylates and vinyl acetate such as poly(vinyl-m-bromobenzoate-co-vinyl acetate); chlorinated poly(olefins), such as chlorinated poly(ethylene); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the charge transport layers of the invention are sold under such tradenames as VITEL PE-101, Piccopale 100, Saran F-220, and LEXAN 145. Other types of binders which can be used in charge transport layers include such materials as paraffin, mineral waxes, etc, as well as combinations of binder materials.

In general, it has been found that those polymers which are especially useful in p-type charge-transport layers include styrene-containing polymers, poly(vinyl carbazole), chlorinated polyolefins, bisphenol-A polycarbonate polymers, phenol-formaldehyde resins, polyesters such as poly[ethylene-coisopropylidene-2,2-bis-(ethyleneoxyphenylene)] terephtalate, and copolymers of vinyl haloarylates and vinylacetate such as poly(vinyl-m-bromobenzoate-co-vinyl acetate).

The charge-transport layer may also contain other noninterfering addenda such as leveling agents, surfactants, plasticizers, and the like to enhance or improve various physical properties of the charge-transport layer.

The thickness of the charge-transport layer may vary. It is especially advantageous to use a charge-transport layer which is thicker than that of the charge-generation layer, with best results generally being obtained when the charge-transport layer is from about 5 to about 200 times, and particularly 10 to 40 times, as thick as the charge-generation layer. A useful thickness for the charge-generation layer is within the range of from about 0.1 to about 15 microns dry thickness, particularly from about 0.5 to about 3.5 microns. However, as indicated hereinafter, good results can also be obtained using a charge-transport layer which is thinner than the charge-generation layer.

The charge-transport layers described herein are typically applied to the desired substrate by coating a liquid dispersion or solution containing the charge-transport layer components. Typically, the liquid coating vehicle used is an organic vehicle. Typical organic coating vehicles include 1. Aromatic hydrocarbons such as benzene, naphthalene, etc., including substituted aromatic hydrocarbons such as toluene, xylene, mesitylene, etc.;
2. Ketones such as acetone, 2-butanone, etc.;
3. Halogenated aliphatic hydrocarbons such as methylene chloride, chloroform, ethylene chloride, etc.;
4. Ethers including cyclic ethers such as tetrahydrofuran, ethylether;
5. Mixtures of the above.

The charge-generation layer used in the present invention comprises a layer of the heterogeneous or aggregate composition as described in Light, U.S. Pat. No. 3,615,414 issued Oct. 26, 1971. These aggregate compositions have a multiphase structure comprising (a) a discontinuous phase of at least one particulate co-crystalline compound or complex of a pyrylium-type dye salt and an electrically insulating, film-forming polymeric material containing an alkylidene diarylene group as a recurring unit and (b) a continuous phase comprising an electrically insulating film-forming polymeric material. Optionally, one or more charge-transport material(s) may also be incorporated in this multiphase structure. Of course, these multi-phase compositions may also contain other addenda such as leveling agents, surfactants, plasticizers, and the like to enhance or improve various physical properties of the charge-generation layer.

The aggregate charge-generation composition may be prepared by several techniques, such as, for example, the so-called "dye first" technique described in Gramza et. al., U.S. Pat. No. 3,615,396 issued Oct. 26, 1971. Alternatively, these compositions may be prepared by the so-called "shearing" method described in Gramza, U.S. Pat. No. 3,615,415 issued Oct. 26, 1971. Still another method of preparation involves preforming the finely-divided aggregate particles such as is described in Gramza et. al., U.S. Pat. No. 3,732,180 and simply storing these preformed aggregate particles until it is desired to prepare the charge-generation layer. At this time, the preformed aggregate particles may be dispersed in an appropriate coating vehicle together with the desired film-forming polymeric material and coated on a suitable substrate to form the resultant aggregate charge-generation composition.

In any case, by whatever method prepared, the aggregate composition exhibits a separately identifiable multi-phase structure. The heterogeneous nature of this multi-phase composition is generally apparent when viewed under magnification, although such compositions may appear to be substantially optically clear to the naked eye in the absence of magnification. There can, of course, be microscopic heterogeneity. Suitably, the co-crystalline complex particles present in the continuous phase of the aggregate composition are finely-divided, that is, typically predominantly in the size range of from about 0.01 to about 25 microns.

The terms "co-crystalline complex" or "co-crystalline compound" are used interchangeably herein and have reference to a co-crystalline compound which contains dye and polymer molecules co-crystallized in a single crystalline structure to form a regular array of molecules in a three-dimensional pattern. It is this particulate co-crystalline material dispersed in the continuous polymer phase of the aggregate charge-generation layer which, upon being exposed to activating radiation in the presence of an electric field, generates electron-hole pairs in the multi-active photoconductive elements of the present invention.

Another feature characteristic of conventional heterogeneous or aggregate compositions such as those described in U.S. Pat. Nos. 3,615,414 and 3,732,180 is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregate composition is not necessarily an overall maximum for the system as this will depend on the relative amount of dye in the aggregate. The shift in absorption maximum which occurs due to the formation of the co-crystalline complex in conventional aggregate compositions is generally of the magnitude of at least about 10 nanometers.

As suggested earlier herein, those charge-generation layers which have been found especially advantageous for use in those embodiments of the invention relating to visible light sensitive multi-active elements are charge-generation layers containing a particulate aggregate material having its principal absorption band of radiation in the visible region of the spectrum within the range of from about 520 nm. to about 700 nm.

The pyrylium type dye salts useful in preparing the co-crystalline complex contained in the charge-generation layer of the present invention includes pyrylium, bispyrylium, thiapyrylium, and selenapyrylium dye salts; and also salts of pyrylium compounds containing condensed ring systems such as salts of benzopyrylium and napthopyrylium dyes are useful in forming such compositions. Typical pyrylium-type dye salts from these classes which are useful in forming these co-crystalline complexes are disclosed in Light, U.S. Pat. No. 3,615,414 noted above.

Particularly useful pyrylium-type dye salts which may be employed in forming the co-crystalline complex are salts having the formula:

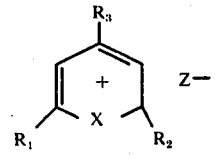

wherein:

$R_1$ and $R_2$ can each be phenyl groups, including substituted phenyl groups having at least one substituent chosen from alkyl groups of from 1 to about 6 carbon atoms and alkoxy groups having from 1 to about 6 carbon atoms;

$R_3$ can be an alkylamino-substituted phenyl group having from 1 to 6 carbon atoms in the alkyl group, and including dialkylamino-substituted and haloalkylamino-substituted phenyl groups;

X can be an oxygen, selenium, or a sulfur atom; and $Z^-$ is an anionic function, including such anions as perchloride, fluoroborate, iodide, chloride, bromide, sulfate, periodate, p-toluenesulfonate, hexafluorophosphate, and the like.

The film-forming polymer used in forming the co-crystalline complex contained in the charge-generation layer used in the present invention may include any of a variety of film-forming polymeric materials which are electrically insulating and have an alkylidene diarylene group in a recurring unit such as those linear polymers, including copolymers, containing the following group in a recurring unit:

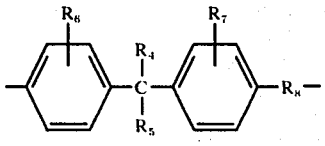

wherein:

$R_4$ and $R_5$, when taken separately, can each be a hydrogen atom, an alkyl group having from one to about 10 carbon atoms such as methyl, ethyl, isobutyl, hexyl, heptyl, octyl, nonyl, decyl, and the like including substituted alkyl groups such as trifluoromethyl, etc., and an aryl group such as phenyl and naphthyl, including substituted aryl groups having such substituents as a halogen atom, an alkyl group of from 1 to about 5 carbon atoms, etc.; and $R_4$ and $R_5$, when taken together, can represent the carbon atoms necessary to complete a saturated cyclic hydrocarbon group including cycloalkanes such as cyclohexyl and polycycloalkanes such as norbornyl, the total number of carbon atoms in $R_4$ and $R_5$ being up to about 19;

$R_6$ and $R_7$ can each be hydrogen, an alkyl group of from 1 to about 5 carbon atoms, e.g., or a halogen such as chloro, bromo, iodo, etc.; and $R_8$ is a divalent group selected from the following:

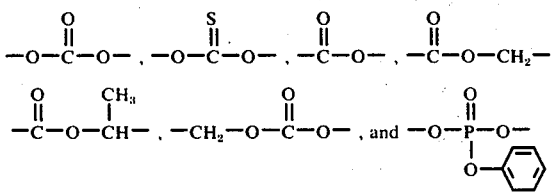

Polymers especially useful in forming the aggregate crystals are hydrophobic carbonate polymers containing the following group in a recurring unit:

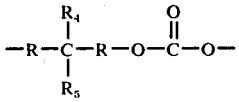

wherein:

Each R is a phenylene group including halo substituted phenylene groups and alkyl substituted phenylene groups; and $R_4$ and $R_5$ are as described above. Such compositions are disclosed, for example, in U.S. Pat. Nos. 3,028,365 and 3,317,466. Preferably polycarbonates containing an alkylidene diarylene moiety in the recurring unit such as those prepared with Bisphenol A and including polymeric products of ester exchange between diphenylcarbonate and 2,2-bis-(4-hydroxyphenyl)propane are useful in the practice of this invention. Such compositions are disclosed in the following U.S. Pat. Nos. 2,999,750 by Miller et. al., issued Sept. 12, 1961; 3,038,874 by Laakso et. al., issued June 12, 1962; U.S. Pat. No. 3,038,879 by Laakso et. al., issued June 12, 1962; 3,038,880 by Laakso et. al., issued June 12, 1962; 3,106,544 by Laakso et. al., issued Oct. 8, 1963; 3,106,545 by Laakso et. al., issued Oct. 8, 1963, and 3,106,546 by Laakso et. al., issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers of Table 4 are included among the materials useful in the practice of this invention:

TABLE 4

| Number: | Polymeric material |
|---|---|
| 1 | Poly(4,4'-isopropylidenediphenylene-co-1-4-cyclohexylenedimethylene carbonate). |
| 2 | Poly(ethylenedioxy-3,3'-phenylene thiocarbonate). |
| 3 | Poly(4,4'-isopropylidenediphenylene carbonate-co-terephthalate). |
| 4 | Poly(4,4'-isopropylidenediphenylene carbonate). |
| 5 | Poly(4,4'-isopropylidenediphenylene thiocarbonate). |
| 6 | Poly(4,4'-sec-butylidenediphenylene carbonate). |
| 7 | Poly(4,4'-isopropylidenediphenylene carbonate-block-oxyethylene). |
| 8 | Poly(4,4'-isopropylidenediphenylene carbonate-block-oxytetramethylene). |
| 9 | Poly[4,4'-isopropylidenebis(2-methylphenylene)-carbonate]. |
| 10 | Poly(4,4'-isopropylidenediphenylene-co-1,4-phenylene carbonate). |
| 11 | Poly(4,4'-isopropylidenediphenylene-co-1,3-phenylene carbonate). |
| 12 | Poly(4,4'-isopropylidenediphenylene-co-4,4'-diphenylene carbonate). |
| 13 | Poly(4,4'-isopropylidenediphenylene-co-4,4'-oxydiphenylene carbonate). |
| 14 | Poly(4,4'-isopropylidenediphenyleneco-4,4'-carbonyldiphenylene carbonate). |
| 15 | Poly(4,4'-isopropylidenediphenylene-co-4,4'-ethylenediphenylene carbonate). |
| 16 | Poly[4,4'-methylenebis(2-methylphenylene)carbonate]. |
| 17 | Poly[1,1-(p-bromophenylethylidene)bis(1,4-phenylene)carbonate]. |
| 18 | Poly[4,4'-isopropylidenediphenylene-co-4,4-sulfonyldiphenylene)carbonate]. |
| 19 | Poly[4,4'-cyclohexylidene(4-diphenylene) carbonate]. |
| 20 | Poly[4,4'-isopropylidenebis(2-chlorophenylene) carbonate]. |
| 21 | Poly(4,4'-hexafluoroisopropylidenediphenylene carbonate). |
| 22 | Poly(4,4'-isopropylidenediphenylene 4,4'- |
| 23 | Poly(4,4'-isopropylidenedibenzyl 4,4'-isopropylidenedibenzoate). |
| 24 | Poly[4,4'-(1,2-dimethylpropylidene)diphenylene carbonate]. |
| 25 | Poly[4,4'-(1,2,2-trimethylpropylidene)diphenylene carbonate]. |
| 26 | Poly 4,4'-[1-(αnaphthyl)ethylidene] diphenylene carbonate . |
| 27 | Poly[4,4'-(1,3-dimethylbutylidene)diphenylene carbonate]. |
| 28 | Poly[4,4'-(2-norbornylidene)diphenylene carbonate]. |
| 29 | Poly[4,4'-(hexahydro-4,7-methanoindan-5-ylidene)diphenylene carbonate]. |

The film-forming electrically insulating polymeric material used in forming the continuous phase of the aggregate charge-generation layer of the present invention may be selected from any of the above-described polymers having an alkylidene diarylene group in a recurring unit. In fact, best results are generally obtained when the same polymer is used to form the co-crystalline complex and used as the matrix polymer of the continuous phase of the aggregate composition. This is especially true when the aggregate particles are formed in situ as the aggregate composition is being formed or coated such as described in the so-called "dye-first" or "shearing" methods described above. Of course, where the particulate co-crystalline complex is preformed and then later admixed in the coating dope which is used to coat the aggregate composition, it is unnecessary for the polymer of the continuous phase to be identical to the polymer contained in the co-crystalline complex itself. In such case, other kinds of film-forming, electrically insulating materials which are well-known in the polymeric coating art may be employed. However, here to it is often desirable to use a film-forming electrically insulating polymer which is structurally similar to that of the polymer contained in the co-crystalline complex so that the various constituents of the charge-generation layer are relatively compatible with one another for purposes of, for example, coating. If desired, it may be advantageous to incorporate other kinds of electrically insulating film-forming polymers in the aggregate coating dope, for example, to alter various physical or electrical properties, such as adhesion, of the aggregate charge-generation layer.

The amount of the above-described pyrylium type dye salt used in the aggregate charge-generation layer may vary. Useful results are obtained by employing the described pyrylium-type dye salts in amounts of from about 0.001 to about 50 percent based on the dry weight of the charge-generation layer. When the charge-generation layer also has incorporated therein one or more charge-transport materials, useful results are obtained by using the described dye salts in amounts of from about 0.001 to about 30 percent by weight based on the dry weight of the charge-generation layer, although the amount used can vary widely depending upon such factors as individual dye salt solubility, the polymer contained in the continuous phase, additional charge transport materials, the electrophotographic response desired, the mechanical properties desired, etc. Similarly, the amount of dialkylidene diarylene group-containing polymer used in the charge-generation layer of the multi-active elements of the invention may vary. Typically, the charge-generation layer contains an amount of this polymer within the range of from about 20 to about 98 weight percent based on the dry weight of the charge-generation layer, although larger or smaller amounts may also be used.

As noted above, it has been found advantageous to incorporate one or more p-type charge-transport materials in the aggregate composition. Especially useful such materials are organic, including metallo-organic, materials which can be solubilized in the continuous phase of the aggregate composition. By employing these materials in the aggregate composition, it has been found that the resultant sensitivity of the multi-active photoconductive element of the present invention can be enhanced. Although the exact reason for this enhancement is not completely understood, it is believed that the charge-transport material solubilized in the continuous phase of the charge-generation layer aids in transporting the charge carriers generated by the particulate co-crystalline complex of the charge-generation layer to the charge-transport layer and thereby prevents recombination of the charge carriers, ie., the electron-hole pairs, in the charge-generation layer.

The kinds of charge-transport materials which may be incorporated in the charge-generation layer include any of the charge-transport materials described above for use in the charge-generation layer. As is the case with the charge-transport layer, if a charge-transport material is incorporated in the aggregate charge-generation layer, it is preferred (although not required) that the particular material selected is one which is incapable of generating any substantial number of electron-hole pairs when exposed to activating radiation for the co-crystalline complex of the charge-generation layer. In this regard, however, it has been found advantageous in accord with certain embodiments of the invention to incorporate a charge-transport material in the aggregate charge-generation layer which, although insensitive to activating radiation for the co-crystalline complex, e.g. visible light in the 520–700 nm. region, is sensitive to, or is capable of sensitizing the co-crystalline complex to, visible light in the 400–520 nm. region of the visible spectrum.

When a charge-transport material is incorporated in the charge-generation layer, the amount which is used may vary depending on the particular material, its compatibility, for example, solubility in the continuous polymeric binder of the charge-generation layer, and the like. Good results have been obtained using an amount of charge-transport material in the charge-generation layer within the range of from about 2 to about 50 weight percent based on the dry weight of the charge-generation layer. Larger or smaller amounts may also be used.

The multilayer photoconductive elements of the invention can be affixed, if desired, directly to a conducting substrate. In some cases, it may be desirable to use one or more intermediate subbing layers between the conducting substrate to improve adhesion to the conducting substrate and/or to act as an electrical barrier layer between the multi-active element and the conducting substrate as described in Dessauer, U.S. Pat. No. 2,940,348. Such subbing layers, if used, typically have a dry thickness in the range of about 0.1 to about 5 microns. Typical subbing layer materials which may be used include film-forming polymers such as cellulose nitrate, polyesters, copolymers of poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. A partial list of representative vinylidene chloride-containing polymers includes vinylidene chloride-methyl methacrylate-itaconic acid terpolymers as disclosed in U.S. Pat. No. 3,143,421. Various vinylidene chloride containing hydrosol tetrapolymers which may be used include tetrapolymers of vinylidene chloride, methyl acrylate, acrylonitrile, and acrylic acid as disclosed in U.S. Pat. No. 3,640,708. A partial listing of other useful vinylidene chloride-containing copolymers includes poly(vinylidene chloridemethyl acrylate), poly(vinylidene chloride-methacrylonitrile), poly(vinylidene chloride-acrylonitrile), and poly(vinylidene chloride-acrylonitrile-methyl acrylate). Other useful subbing materials include the so-called tergels which are described in Nadeau et. al. U.S. Pat. No. 3,501,301.

Optional overcoat layers may be used in the present invention, if desired. For example, to improve surface hardness and resistance to abrasion, the surface layer of the multiactive element of the invention may be coated with one or more electrically insulating, organic polymer coatings or electrically insulating, inorganic coatings. A number of such coatings are well known in the art and accordingly extended discussion thereof is unnecessary. Typical useful such overcoats are described, for example, in Research Disclosure, "Electrophotographic Elements, Materials, and Processes," Volume 109, page 63, Paragraph V, May, 1973, which is incorporated by reference herein.

The multi-active elements of the invention may be affixed, if desired, to a variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum and the like coated on paper or conventional photographic film bases such as cellulose acetate, polystyrene, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer cntaining a semiconductor dispersed in a resin. Such conducting layers both with and without electrical barrier layers are described in U.S. Pat. No. 3,245,833 by Trevoy, issued Apr. 12, 1966. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Pat. No. 3,880,657 issued Apr. 29, 1975. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. No. 3,997,901 by Minsk, issued Nov. 7, 1961 and 3,262,807 by Sterman et. al., issued July 26, 1966.

The following examples are included for a further understanding of the invention.

EXAMPLES

Introduction

The multi-active photoconductive compositions of the invention are typically utilized in the following general manner. The elements are formulated into "films" by temporarily or permanently affixing the charge-generation layer of the multi-active element to an electrically conductive surface of a synthetic film base to establish electrical contact between the charge-generation layer and the conductive surface of the film base. A typical film base used in the following examples is a subbed poly(ethylene terephthale) film support bearing an electrically conductive layer of vacuum-evaporated 0.4 optical density nickel. The charge transport surface layer of the resultant films are then charged with a high voltage corona discharge to a given surface potential and a portion of the film surface is then discharged, with a visible light exposure, to a substantially lower surface potential. The entire film is then recharged and a voltage differential appears between the exposed and unexposed areas of the film. The charging cycle can be repeated many times with substantially the same results as observed in the first recharging operation. The voltage differential that occurs between the exposed and unexposed portions of the photoreceptor film can be "toned", i.e. electrostatically developed, to produce a copy of the original image.

The following procedures were used to test the electrographic films of the following Examples for persistent conductivity. These tests are carried out at standard pressure and room temperature conditions. (i.e. 22° C., 1 atmosphere).

Test No. 1. This is a repetitive cyclic test developed to provide a useful indication of the characteristics of persistent conductivity in a photoconductive film which is used as a single exposure, multicopy electrophotographic master. A dark adapted film is placed on a rotary drum sensitometer and is charged to approximately −600 V with a control grid charger. The element, one-half of which is covered by a 4.0 neutral density filter, is exposed to 4200 meter candle seconds of tungsten light. After exposure, the drum is run continuously at 20 rpm past the corona and then a field meter. Successive "charge cycles" consisting of charging and recording the voltage level of the exposed and unexposed areas in sequence occur as the film is rotated on the rotary drum past the corona and field meter. Each charge cycle takes about 3 seconds. The recorded data are then the voltage level of the two portions of the film, i.e., the exposed portion (designated $V_{exp}$) and the unexposed portion (designated $V_{unexp}$), as a function of charge cycle. As the number of charge cycles increase, $\Delta V$ (i.e., the difference between $V_{exp}$ and $V_{unexp}$ measured for each successive charge cycle) decreases. Typically, a film which exhibits useful persistent conductivity exhibits a $\Delta V$ of more than 300 volts even after 10 charge cycles.

Test No. 2. This test is a modification of a conventional photodecay test. It gives a more flexible and precise control of the exposure and the initial charging conditions than test No. 1, although it is not well suited to repetitive testing procedures. The film is placed on a grounded paddle that travels linearly and continuously from a loading position past a corona position and then to a field meter and exposing position. The same is set to travel the 10 cm. distance between the corona station and the field meter stations in 6.0 seconds. The sample is loaded, the corona set to charge films to about 740V and the sample is driven to the field meter. The initially recorded charge level is designated as $1V_1$. The shutter is tripped when the voltage when the voltage level is at 700V and the photodecay curve recorded, generally until 60 or 100 ergs/cm$^2$ of monochromatic light, normally 680nm, is incident on the film. The voltage level after this exposure is designated $1V_2$ (and is generally within the toe region of the photodecay curve). The sample is then driven down to the loading position with the corona off. The corona is then set at the same level as the initial charger (i.e., 740V) and the sample is driven past the corona (charge cycle two) to the field meter. The initially recorded voltage level obtained about 2.5 seconds after charging is $2V_1$. The difference between $1V_1$ and $2V_1$ designated $\Delta V_1$ is taken as a measure of the light induced persistence.

EXAMPLE 1

A set of three different photoconductive materials capable of producing a persistently conducting electrographic film are compared in three different film formats; a single layer homogeneous film, a single layer aggregate film and the multi-active film of this invention. Each of the three film compositions are coated on a conductive film base as described in the Introduction immediately above. The composition of these three different film formats was as follows:

Single Layer Homogeneous Film (Control)

This film consisted of a 10 micron thick (dry thickness) layer composed of a soild solution of tri-paratolylamine organic photoconductor (40 percent by weight) dissolved in Vitel PE101X polymer (a poly-[ethylene-co-isopropylidene-2,2-bis(ethyleneoxyphenyl)terephthalate] terpolymer purchased from Goodyear) (56 percent by weight). This layer also contained about 2 percent by weight of 2,6-diphenyl-4-(4'-dimethylaminophenyl)thiapyrylium perchlorate as sensitizing dye and about 2 percent by weight of pentafluorobenzoic acid as the protonic acid.

Single Layer Aggregate Film (Control)

This film consisted of a single 10 micron thick (dry thickness) layer of an aggregate photoconductive composition containing tri-para-tolyiamine (40 percent by weight), Lexan 45 polycarbonate purchased from General Electric Co. (55 percent by weight), 2,6-diphenyl-4-(4'-dimethylaminophenyl)-thiapyrylium perchlorate (3 percent by weight) and pentafluorobenzoic acid (2% by weight). This aggregate film was made in a substantially identical manner to that described in Example 1 of U.S. Pat. No. 3,706,554, issued Dec. 19, 1972, with the exception that pentafluorobenzoic acid was incorporated in the layer by admixing this material in the aggregate coating dope prior to coating and formation of the aggregate co-crystalline complex which occurs in situ on the film base upon coating and drying the aggregate dope thereon.

Multi-Active Aggregate Film

This film consisted of an aggregate charge-generation layer contacting the conductive film base and a charge-transport coated on and in electrical contact with the surface of the aggregate charge-generation layer opposite the conductive film base. The dry thickness of the charge-generation layer was about 3 microns and the dry thickness of the charge-transport layer was about 10 microns. The coating formulation of the charge-transport layer was as follows:

| | |
|---|---|
| chloroform | 9.7 parts by weight |
| Lexan[a] 145 polycarbonate | 0.8 parts by weight |
| tri-p-tolylamine | 0.53 parts by weight |
| pentafluorobenzoic acid | 0.03 parts by weight |

The coating formulation of the charge-generation layer was as follows:

| | |
|---|---|
| high viscosity Bisphenol A polycarbonate | 32.2 g. |
| 2,6-diphenyl-4-(4'-dimethylaminophenyl) thiapyrylium perchlorate | 6.80 g. |
| reagent grade methylene chloride | 1455 g. |

The above-noted charge-generation layer coating formulation was filtered prior to coating to remove undissolved material. Subsequent to coating, the charge-generation layer coating was dried and then overcoated with toluene at the rate of 4 ml./ft.$^2$ to aggregate the pyrylium-type dye salt and polycarbonate contained in the charge-generation layer. The charge-generation layer was then overcoated with the above-noted charge-transport layer coating formulation using a 0.012 cm. doctor blade. The method used for preparing this multi-active film was similar to that described in Example 2 of copending Berwick et al application Ser. No. 534,979 dated Dec. 20, 1974 except that pentafluorobenzoic acid was inserted in the coating formulation of the transport layer. The data for persistent conductivity and exposure level is given in Table I for these three films.

Table I

Voltage Differentials for Recharging of Pentafluorobenzoic Acid Doped Photoconductor Films

| | Test No. 1 (ΔV) | | Test No. 2 | | | |
|---|---|---|---|---|---|---|
| Film Type | ΔV10c[a] | Comment[b] | $\Delta V_1$ | Relative Sensitivity[c] | Comment[b] | Speed |
| Homogeneous (Control) | 520 | Excellent | 500 | 1.00 | Excellent | Low |
| Aggregate-Single Layer (Control) | 140 | Poor | 100 | 0.091 | Poor | High |
| Multi-active Aggregate | 540 | Excellent | 600 | 0.0083 | Excellent | Very-High |

[a]Voltage differential between exposed and unexposed film areas after ten charge cycles.
[b]Judgment of persistence level.
[c]Relative sensitivity represents the relative amount of energy required to discharge the films from −500 to −100 volts residual potential as compared to the homogeneous film which is arbitrarily assigned a relative sensitivity of 1.0. The listed values are for exposures made at the absorption maxima for each film which was at 600 nm for the homogeneous film and 680 mn for the two aggregate-containing films.

The homogeneous film was observed to have high levels of persistent photoconductivity but required exposures 100 times greater than are required to discharge the multi-active type films. The single layer aggregate films do not show a persistent photoconductivity level that would be useful in electrophotographic imaging. The multi-active film of this invention, however, produced voltage differentials between exposed and unexposed regions large enough for use in electrophotographic imaging. Additionally, the multi-active films of this invention are capable of producing persistently conducting images with low exposure levels.

EXAMPLE 2 (CONTROL-OUTSIDE SCOPE OF INVENTION)

A charge generating layer was prepared in the following manner: 38.2 g of high viscosity bisphenol A polycarbonate and 6.80 g of 2,6-diphenyl-4-(4'-dimethylaminophenyl)thiapyrylium perchlorate were dissolved with stirring in 1455 g of reagent grade methylene chloride. The mixture was filtered to remove undissolved material. The mixture was coated at 0.25 g/ft$^2$ on 0.4 OD Ni coated poly(ethylene terephthalate substrate using an extrusion hopper. The dried coating was overcoated with toluene at the rate of 4 ml/ft$^2$. This produced an aggregate charge generating layer.

A charge-transport coating formulation containing 19.4 parts chloroform, 1.6 parts Lexan 145 polycarbonate, 1.1 parts 4,4'-bis-(N,N-diethylamino)tetraphenyl methane and 0.059 parts 3,5-dinitrobenzoic acid was prepared and with a 0.012 cm. doctor blade over the charge-generating layer described above.

A similar charge transport coating was prepared without the incorporation of the benzoic acid component and coated with a 0.012 cm. doctor blade over the charge-generation layer described above in this Example to serve as a control multi-active film.

Test No. 1 with a 4200 mcs tungsten exposure yielded no appreciable differences between the dinitrobenzoic acid doped and control film. Both films accepted substantially maximum voltage on the third recharging cycle. Test No. 2 using a 70 ert/cm$^2$ exposure at 680 nm gave the same results for both the acid doped multi-active film and the control. The control gave a $\Delta V_1$ of 15 volts; the test film gave a $\Delta V_1$ of 5 volts.

EXAMPLe 3 (CONTROL-OUTSIDE SCOPE OF INVENTION)

A mixture containing 20.0 parts of chloroform, 2.0 parts of polyvinylcarbazole, 1.3 parts of 4,4'-bis-(diethylamino)tetraphenyl methane and 0.04 parts of 5-fluorosalicyclic acid was coated with a 0.012 cm. coating blade on the charge-generating layer described in Example 2. Under the conditions of Test No. 1 with a 4200 mcs tungsten exposure, this film maintained a charge in the exposed region at the same level as the unexposed region after the third charge cycle. Test No. 2 with a 60 erg/cm$^2$ exposure at 680 nm gave no voltage differential between the exposed and unexposed conditions of the film, i.e., $\Delta V_1 = O$. The film, shows little or no persistent photoconductivity.

EXAMPLE 4

A mixture of 9.7 parts chloroform, 0.8 parts Lexan 145 polycarbonate, 0.53 parts tritolylamine, 0.03 parts pentafluorobenzoic acid was prepared and coated with a 0.012 cm. coating blade over the charge-generating layer described in Example 2.

Test No. 1 with a 4200 mcs exposure yielded ten charging cycles, a voltge differential between exposed (90 V) and unexposed (630 V) regions of the film of 540 volts. This voltage differential did not change between the 5th and 10th charge cycle.

Test No. 2 with a 60 erg/cm$^2$ exposure at 680 nm produced an initial voltge differential of 600 volts between the exposed (120 V) and unexposed (720 V) regions of the film. With a 12 erg/cm$^2$ exposure required to discharge the film from 700 V to 100 V substantially the same results were obtained.

EXAMPLES 5–8

Following in Table II are some further examples employing different acids in the formulation described in Example 4.

EXAMPLE 9

A mixture containing 7 parts polyvinylcarbazole, 93 parts, 1,2-dichloroethane, 4.9 parts tritolylamine and 0.22 parts of mandelic acid was prepared and coated with a 0.012 cm. doctor blade over the charge-generating layer described in Example 2. Test No. 1 produced a voltage differential after 10 recharging cycles of 540 volts (620/90). Test No. 2 produced a voltage differential $\Delta V_1$ of 600 volts.

EXAMPLES 10–14

The following (Table III) are further examples of protonic acids used in the formulation described in Example 9.

Table II

Surface Potentials for Various Acid Doped Multi-Active Persistent Films of Example 4

| | | Test No. 1($V_{exp}$)[a] | | | Test NO. 2 | |
|---|---|---|---|---|---|---|
| Example | Protonic Acid | 5 cycles | 10 cycles | Comments | $\Delta V_1$ | Comments |
| 5 | 3,5-Dinitrobenzoic acid | 100 | 120 | Excellent | 160 | Fair |
| 6 | 2,4-Dinitrobenzoic acid | 100 | 200 | Good | 350 | Good |
| 7 | 5-Nitrosalicyclic acid | — | — | | 630 | Excellent |
| 8 | 4-Nitrophthalic acid | — | — | | 600 | Excellent |
| 9 | Picric acid | 50 | 50 | Excellent | — | — |

[a]Negative surface potential of exposed portion of photoreceptor film.

Table III

Surface Potentials of Various Acid Doped Persistent Films of Example 9

| | | Test No. 1 ($V_{exp}$) | | | Test No. 2 | |
|---|---|---|---|---|---|---|
| Example | Protonic Acid | 5 cycles | 10 cycles | Comments | $\Delta V_1$ | Comments |
| 10 | 5-Chloro-2-nitro benzoic acid | 45 | 50 | Excellent | 400 | Good |
| 11 | 5-Fluoro-2-hydroxy-benzoic acid | — | — | | 630 | Excellent |
| 12 | 3,5-Dinitrobenzoic acid | 50 | 60 | Excellent | 600 | Excellent |
| 13 | 4-Chloro-3-nitro-benzoic acid | 90 | 100 | Excellent | 550 | Excellent |

Table III-continued

| Surface Potentials of Various Acid Doped Persistent Films of Example 9 | | | | | | |
|---|---|---|---|---|---|---|
| | | Test No. 1 ($V_{exp}$) | | | Test No. 2 | |
| Example | Protonic Acid | 5 cycles | 10 cycles | Comments | $\Delta V_1$ | Comments |
| 14 | Picric acid | 40 | 40 | Excellent | 600 | Excellent |

EXAMPLE 15

A mixture containing 2 parts of chloroform, 1 part of Lexan 145 polycarbonate, 0.034 parts 3,5-dinitrobenzoic acid and 0.65 parts ditotyl-2′,4′-dichlorostilbylamine was coated with a 0.012 cm. coating blade over the charge generating layer described in Example 2. Test No. 1 with a 4200 mcs tungsten exposure produced a voltage differential of 430 volts (820/390) after 10 charging cycles. Test No. 2 with a 60 erg/cm$^2$ exposure at 680 nm produced a voltage differential $\Delta V_1$ of 350 volts. Both tests indicate that this formulation exhibits useful levels of persistent conductivity.

EXAMPLES 16–22

Following in Table IV are some further examples of my invention employing different organic photoconductors in the formulation described in Example 15 except where noted.

Table IV

| Surface Potentials of Various Photoconductors in Persistant Multi-Active Film of Example 15 | | | | | |
|---|---|---|---|---|---|
| | Organic | Test No. 1 ($V_{exp}$) | | Test No. 2 | |
| Example | Photoconductor | 10 cycles | Comments | $\Delta V_1$ | Comments |
| 16 | p-ditolyl-(4-phenylbutadiene)phenyl amine | 80 | Excellent | 400 | Good |
| 17 | p-ditolyl-p-anisylamine | 90 | Excellent | 450 | Good |
| 18 | 4-Di(p-tolylamine)-4′-[4-(di-p-tolylamino)-styryl]stilbene | 65 | Excellent | — | |
| 19 | tri-p-tolylamine | 180 | Good | 450 | Good |
| 20 | p-anisyl-diphenyl amine | 220 | Good | — | |
| 21 | tri-p-bromo-phenylamine (control - outside scope of invention) | 820 | Poor | 10[b] | Poor |
| 22 | tri-phenylamine (control - outside scope of invention) | 650 | Poor | 35[b] | Poor |

[a]Acid in this example was 5-chloro-2-nitrobenzoic.
[b]1000 ergs/cm$^2$ exposure at 680 nm.

EXAMPLE 23

The multi-active element described in Example 4 was utilized to demonstrate thermal regeneration of the elements of this invention. The film was charged to a surface potential of −700 volts. The sample was exposed for 5 seconds with a Dazor Model 3615 high intensity lamp equipped with 1.3 neutral density and Wratten 21 (orange) filters at a distance 90 cm. The exposure discharged the film to 40 V. The film was heated for 5 minutes at 60° C and recharged to a surface potential of 705 volts (complete regeneration).

Film samples held at 27°, 32° and 43° C were charged to about −700 V and given a 60 ergs/cm$^2$ exposure at 680 nm. The persistence was measured by recharging at 10-minute intervals and measuring the voltage levels for one minute. The half-life of regeneration is defined as the time when the observed voltage level is midway between that of the highly persistent sample and an unexposed fresh sample for both the initial voltage levels ($V_i$) and the voltage levels at one minute ($V_{60}$). The half-lives of regeneration found in this manner for the initial differential are: 11 minutes at 32° C, 5 minutes at 43° C; and for the one minute interval 150 minutes at 27° C, 60 minutes at 32° C, and 15 minutes at 43° C. The regeneration rate at the initial voltage level will reflect copying degradation rates while the one minute values will be indicative of background memory effects. Extrapolation of the data to higher temperatures indicates that regeneration times at about 100° C should be in the range of approximately 3 seconds.

It is useful to review the foregoing examples, bearing in mind the criteria of p-type charge transport materials useful in the practice of this invention. That is, the charge-transport material formed from the material should be thermodynamicalliy stable so that any radical cations formed from the material will not readily serve as oxidizing agents for other substances present in the film; such thermodynamically stable charge-transport materials can be described as having polarographic oxidation potentials versus a standard calomel electrode in acetonitrile between +0.90 and +0.50 volts, and the charge-transport material should be kinetically stable, i.e., it must form radical cations that are chemical stable species, that is, they will not suffer decomposition, dimerization, disproportionation or the like.

In this regard, it is noted that the charge-transport materials such as those in Examples 1, 4–15, and 16–20 satisfy the thermodynamic stability criteria in that all these compounds have relatively low polarographic oxidation potentials within the aforementioned +.50 to +.90 volt range. These compounds yield films of high utility in the practice of this invention. Examples 21 and 22 have significantly higher polarographic oxidation potentials outside the aforementioned +0.50 to +0.90 volt range and are more thermodynamically unstable relative to other materials in these films. The radical cation of Example 22 is well known in organic chemistry as a powerful oxidizing agent. Neither of the films containing these compounds show useful levels of persistent conductivity, and therefore Examples 21 and 22 are outside the scope of the present invention.

The charge-transport material 4,4'-bis-(N,N-diethylamino)tetraphenyl methane of Examples 2 and 3 is an example of a class of compounds known to form radical cations that undergo a decomposition resulting in loss of an N-alkyl group. The radical cation of this charge-transport material is expected to have a significantly shorter lifetime than that of the radical cation derived from the charge-transport material of Examples 4–9. The films of Examples 2 and 3 show virtually no measurable persistent conductivity. Here the absence of kinetic stability for the charge-transport material has been shown to lead to films not useful in the practice of this invention, and therefore Examples 2 and 3 are also outside the scope of the present invention.

The invention has been described in detail with particular reference to preferred embodiments thereof, but, it will be understood that variations and modifications can be effected within the spirit and scope of the invention.

We claim:

1. A photoconductive insulating element having at least two layers comprising a charge-generation layer in electrical contact with a charge-transport layer, a. said charge-generation layer comprising a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, b. said charge-transport layer being an organic composition comprising a p-type organic photoconductive charge-transport material capable of accepting and transporting injected charge carriers from said charge-generation layer, said charge-transport material having a polarographic oxidation potential between about +0.90 and +0.50 volts and the capability of forming chemically stable radical cations, and c. at least one of said charge-transport or said charge-generation layers comprising a protonic acid selected from the group consisting of substituted carbocyclic aromatic carboxylic acids, substituted phenols, substituted naphthols, substituted aliphatic and substituted alicyclic carboxylic acids, and substituted aromatic heterocyclic carboxylic acids, each of the aforementioned protonic acids characterized by the presence of one or more electron-withdrawing substituents such that the sum of the sigma values for the substituents of said protonic acids is equal to or greater than 1.0.

2. A photoconductive insulating element as defined in claim 1 wherein said protonic acid possesses one or more electron-withdrawing substituents selected from the class consisting of a cyano group, a nitro group, an hydroxy group, a cyanoalkylene group, a dicyanoalkylene group, a carboxylic acid anhydride group, a carboxylic acid group, a quinone group, a halogen, a halogenated alkyl group, and a halogenated phenyl group.

3. A photoconductive insulating element as defined in claim 1 wherein said protonic acid comprises a substituted carbocyclic aromatic carboxylic acid having a single carbocyclic aromatic ring bearing one or more carboxylic acid substituents and one or more nitro or halogen substituents.

4. A photoconductive insulating element as defined in claim 1 wherein said protonic acid comprises a substituted aliphatic carboxylic acid having one or more halogenated phenyl groups or nitro-substituted phenyl groups attached as substituents to the aliphatic carboxylic acid group of said substituted aliphatic carboxylic acid.

5. A photoconductive insulating element as defined in claim 1 wherein said p-type charge-transport material is selected from the group consisting of arylamine-containing photoconductive materials, carbazole-containing photoconductive materials, and mixtures thereof.

6. A photoconductive insulating element as defined in claim 1 wherein said charge-transport layer comprises a solid solution of said p-type charge-transport material and said protonic acid in a polymeric binder.

7. A photoconductive insulating element as defined in claim 1 wherein said protonic acid is present in an amount within the range of from about 0.5 to about 7.5 weight percent based on the total dry weight of materials contained in said charge-generation and said charge-transport layer.

8. A photoconductive insulating element as defined in claim 1 wherein said protonic acid is present in said charge-generation layer.

9. A photoconductive insulating element having at least two layers comprising a charge-generation layer in electrical contact with a charge-transport layer, a. said charge-generation layer having a dry thickness within the range of from about 0.5 to about 15.0 microns and comprising a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one thiapyrylium dye salt, said co-crystalline complex, upon exposure to radiation within the range of from about 520 to about 700 nm., capable of generating and injecting charge carriers into said charge-transport layer, b. said charge-transport layer being an organic composition having a dry thickness within the range of from about 5 to about 200 times that of said charge-generation layer and free from said co-crystalline complex and any pyrylium-type dye salt, said charge-transport layer comprising a protonic acid and as a p-type charge-transport material an organic photoconductive material having a principal absorption band below about 475 nm. and capable of accepting and transporting injected charge carriers from said charge-generation layer, said charge-transport material having a polargraphic oxidation potential between about +0.90 and +0.50 volts and the capability of forming chemically stable radical cations, said protonic acid selected from the group consisting of 1. a substituted carbocyclic aromatic carboxylic acid having a single carbocylic aromatic ring bearing one or more carboxylic acid groups and one or more nitro and halogen substituents;
2. a substituted aliphatic carboxylic acid having one or more halogenated phenyl groups or nitro-substituted phenyl groups attached as substituents to the aliphatic carboxylic acid group of said substituted aliphatic carboxylic acid; and
3. mixtures thereof.

10. A photoconductive insulating element as defined in claim 9 wherein said charge-transport material is a p-type organic photoconductor selected from the group consisting of arylamine-containing photoconductive materials, carbazole-containing photoconductive materials, and mixtures thereof.

11. A photoconductive insulating element as defined in claim 9 wherein said charge-transport material is a p-type arylamine organic photoconductor.

12. A photoconductive insulating element as defined in claim 9 wherein said change-transport layer is a p-type polyarylalkane photoconductor having the formula

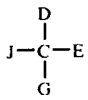

wherein

J and E, which may be the same or different, represent a hydrogen atom, an alkyl group, or an aryl group; and D and G, which may be the same or different represent substituted aryl groups having as a substituent thereof a group represented by the formula

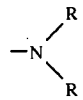

wherein R represents an alkyl substituted aryl group.

13. A photoconductive insulating element as defined in claim 9 wherein said charge-transport material is tritolylamine.

14. A photoconductive insulating element as defined in claim 9 wherein said charge-transport material is selected from the group consisting of p-ditolyl-(4-phenylbutadiene)phenyl amine, p-ditolyl-p-anisylamine, 4-di(p-tolylamine)-4'-[4-(di-p-tolylamino)-styryl]stilbene, tri-p-tolylamine, p-anisyldiphenyl amine, poly(vinyl carbazoles), halogenated poly(vinyl carbazoles), and mixtures thereof.

15. A photoconductive insulating element as defined in claim 9 wherein said protonic acid is selected from the group consisting of 3,5-dinitrobenzoic acid; 2,4-dinitrobenzoic acid; 5-nitrosalicyclic acid; 4-nitrophthalic acid; 5-chloro-2-nitrobenzoic acid; 5-fluoro-2-hydroxybenzoic acid; 4-chloro-3-nitrobenzoic acid; mandelic acid; and pentafluorobenzoic acid.

16. A photoconductive insulating element as defined in claim 9 wherein said protonic acid is 5-fluoro-2-hydroxybenzoic acid and wherein said charge transport material is a mixture of tri-p-tolylamine and poly(vinyl carbazole).

17. A photoconductive insulating element as defined in claim 9 wherein said protonic acid is 5-fluoro-2-hydroxybenzoic acid or pentafluorobenzoic acid.

* * * * *